US008887476B2

(12) United States Patent
Suzuki et al.

(10) Patent No.: US 8,887,476 B2
(45) Date of Patent: Nov. 18, 2014

(54) BREAD PACKAGING SYSTEM

(75) Inventors: Nobuhiro Suzuki, Fujisawa (JP); Shuichi Iribe, Fujisawa (JP); Michinori Watanabe, Fujisawa (JP); Seiichi Akutsu, Fujisawa (JP)

(73) Assignee: Oshikiri Machinery Ltd., Fujisawa-Shi, Kanagawa-Ken (JP)

( * ) Notice: Subject to any disclaimer, the term of this patent is extended or adjusted under 35 U.S.C. 154(b) by 488 days.

(21) Appl. No.: 12/929,165

(22) Filed: Jan. 5, 2011

(65) Prior Publication Data

US 2012/0067705 A1 Mar. 22, 2012

(30) Foreign Application Priority Data

Sep. 21, 2010 (JP) ..... 2010-211468

(51) Int. Cl.
*B65B 5/06* (2006.01)

(52) U.S. Cl.
USPC ..... 53/252; 59/469; 59/235; 59/251; 59/250

(58) Field of Classification Search
USPC ..... 53/467, 469, 235, 249–252
See application file for complete search history.

(56) References Cited

U.S. PATENT DOCUMENTS

| | | | | |
|---|---|---|---|---|
| 3,417,546 | A | 12/1968 | Irwin | |
| 3,421,286 | A | 1/1969 | Chambless, Jr. | |
| 3,421,287 | A | 1/1969 | Sheets | |
| 3,451,192 | A | 6/1969 | Irwin | |
| 3,538,671 | A | 11/1970 | Wallace | |
| 3,556,316 | A | 1/1971 | Marasso et al. | |
| 3,579,957 | A | 5/1971 | Mills, Jr. et al. | |
| 3,603,059 | A * | 9/1971 | Carnes et al. | 53/258 |
| 4,463,627 | A | 8/1984 | Zelle | |
| 4,517,788 | A * | 5/1985 | Scheffers | 53/459 |
| 4,671,048 | A | 6/1987 | Rademacher | |
| 4,694,715 | A | 9/1987 | Jongerius | |
| 5,477,662 | A | 12/1995 | Rompa | |
| 5,743,071 | A | 4/1998 | Wolthuizen | |
| 6,421,984 | B1 | 7/2002 | Murgatroyd et al. | |
| 6,766,898 | B2 | 7/2004 | Lessard et al. | |

FOREIGN PATENT DOCUMENTS

| | | |
|---|---|---|
| JP | 61-081311 | 4/1986 |
| JP | 62-125382 | 6/1987 |
| JP | 62-135144 | 6/1987 |
| JP | 63-21 A | 1/1988 |
| JP | 64-041457 | 2/1989 |

OTHER PUBLICATIONS

Japanese Office Action dated Jul. 11, 2014 with an English translation.

* cited by examiner

*Primary Examiner* — Christopher Harmon
(74) *Attorney, Agent, or Firm* — McGinn IP Law Group, PLLC

(57) ABSTRACT

A bread packaging system comprising: a movable member on which a scoop for holding a packaging member to package bread is mounted; a guide member for defining a moving path along which the movable member is moved; a reciprocating motion mechanism having an endless revolving member for reciprocating the movable member along the guide member; and a link member for linking the endless revolving member with the movable member, wherein the bread packaging system is configured to reciprocate the movable member along the guide member by revolving the endless revolving member in one direction.

28 Claims, 5 Drawing Sheets

BREAD PACKAGING SYSTEM

BACKGROUND OF THE INVENTION

1. Field of the Invention

The present invention relates to a bread packaging system for packaging the bread with a packaging material, in particular, to a bread packaging system comprising a reciprocating motion mechanism that employs an endless revolving member that revolves in a single direction.

2. Description of the Related Art

Bread packaging apparatuses for packaging a long loaf bread (for example, three-loaf length) into a packaging material such as a polyethylene bag have been conventionally used. For example, JP Patent Application Publication No. S63-000021 discloses a conventional bread packaging apparatus comprising a reciprocating motion mechanism that employs a cam and link mechanism. This conventional bread packaging apparatus comprises a scoop that reciprocates a bag stacking unit on which folded polyethylene bags are stacked and a packaging place for wrapping the loaf bread in the bag. The scoop reciprocates between the bag stacking unit and the packaging place in order to hold the packaging material at the bag staking unit and package the loaf bread at the packaging place.

On the other hand, a reciprocating motion mechanism of a bread packaging apparatus disclosed in U.S. Pat. No. 5,743,071 comprises a pair of pulleys spaced apart from each other; and a toothed belt wound around the pair of pulleys. Once the rotation force from a drive motor is transmitted to one of the pulleys, the toothed belt is revolved and thereby the rotation force is transmitted to the other pulley. Further, the loaf bread packaging apparatus comprises a link bar, wherein one end portion of the link bar is connected to the toothed belt and the other end portion of the link bar is connected to the scoop.

The link bar reciprocates in the linear moving area of the toothed belt extending between both pulleys, which allows the scoop to reciprocate. That is, one end portion of the link bar connected to the toothed belt does not pass over both pulleys. Therefore, the drive motor for driving the reciprocating motion mechanism accelerates and decelerates so that the one end portion of the link bar moves from near one pulley toward near the other pulley and, without exceeding that pulley, returns to near the one pulley.

In the reciprocating motion mechanism employing the cam and link as disclosed in JP Patent Application Publication No. S63-000021, not only is the structure complicated, but also the number of link portions of the components becomes great. The larger number of the link portions may cause the noise due to the backlash or looseness at the link portions, which makes it difficult to run the bread packaging apparatus stably for a long term.

Further, the reciprocating motion mechanism as disclosed in U.S. Pat. No. 5,743,071 is configured to reciprocate the link bar linking the scoop with the endless revolving member within the linear moving area between two pulleys by the drive motor. Therefore, it is necessary to abruptly brake the drive motor to reverse the rotation direction when one end portion of the link bar comes to the turning point, and it is necessary to make a rapid acceleration and deceleration when one end portion of the link bar is between the pulleys. As a result, the inertia load applied to the drive motor makes it difficult to ensure the durability of the drive motor.

In addition, it may be possible to use a metal chain as the endless revolving member, however, which tends to increase the noise of the bread packaging apparatus.

SUMMARY OF THE INVENTION

The present invention is provided to address the above situation. That is, the objective of the present invention is to provide a bread packaging system that reduces the number of the link portions to the minimum for stable operation and comprises a simpler reciprocating motion mechanism.

To solve the above problems and to attain the object, a bread packaging system of the present invention comprising: a movable member on which a scoop for holding a packaging member to package bread is mounted; a guide member for defining a moving path along which the movable member is moved; a reciprocating motion mechanism having an endless revolving member for reciprocating the movable member along the guide member; and a link member for linking the endless revolving member with the movable member, wherein the bread packaging system is configured to reciprocate the movable member along the guide member by revolving the endless revolving member in one direction.

A bread packaging apparatus according to the present invention comprises a link member that links a scoop with a reciprocating motion mechanism. Therefore, it can be configured with fewer link portions than the conventional reciprocating mechanism that employs the link and cam, which allows the desired performance to be maintained.

Further, the bread packaging apparatus according to the present invention is configured to rotate an endless revolving member in one direction only to reciprocate a movable member, which eliminates the need for repeating the forward and reverse rotations of the endless revolving member. Therefore, it is not necessary to change the rotation direction by the drive source used to drive the bread packaging system, so that the load to the drive source can be suppressed. As a result, the durability of the bread packaging system can be improved.

Further features of the present invention will become apparent from the following description of exemplary embodiments with reference to the attached drawings.

DESCRIPTION OF THE EMBODIMENTS

Figure 1:
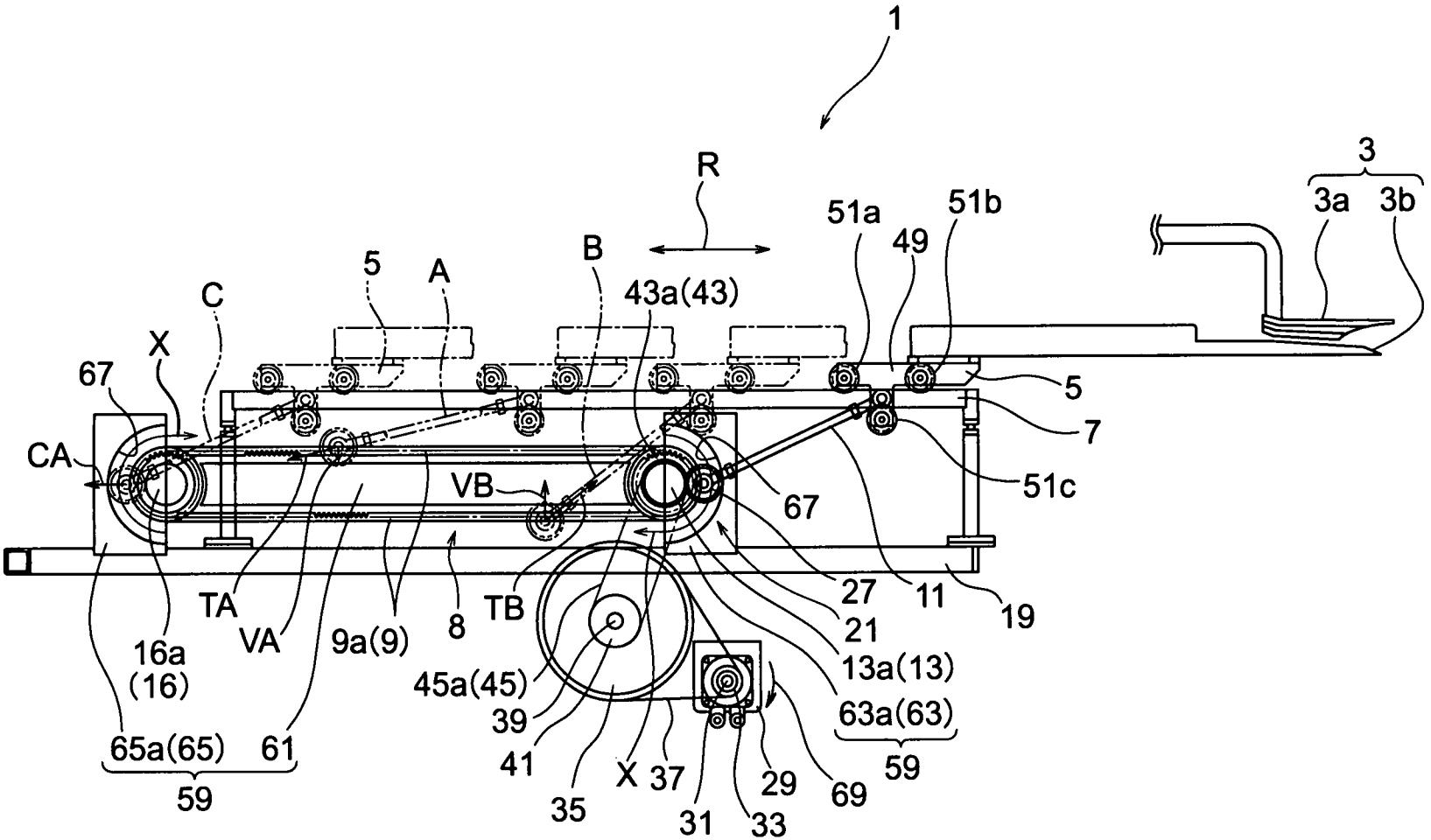
FIG. 1 is a front view schematically showing main components of a loaf bread packaging apparatus according to an embodiment.

Preferred embodiments of the present invention will now be described in detail in accordance with the accompanying drawings.

By referring to the drawings, below will be described a loaf bread packaging apparatus and a loaf bread packaging system according to an embodiment to which a bread packaging system of the present invention is applied. It is noted that the preset invention is not limited to this embodiment.

Figure 2:
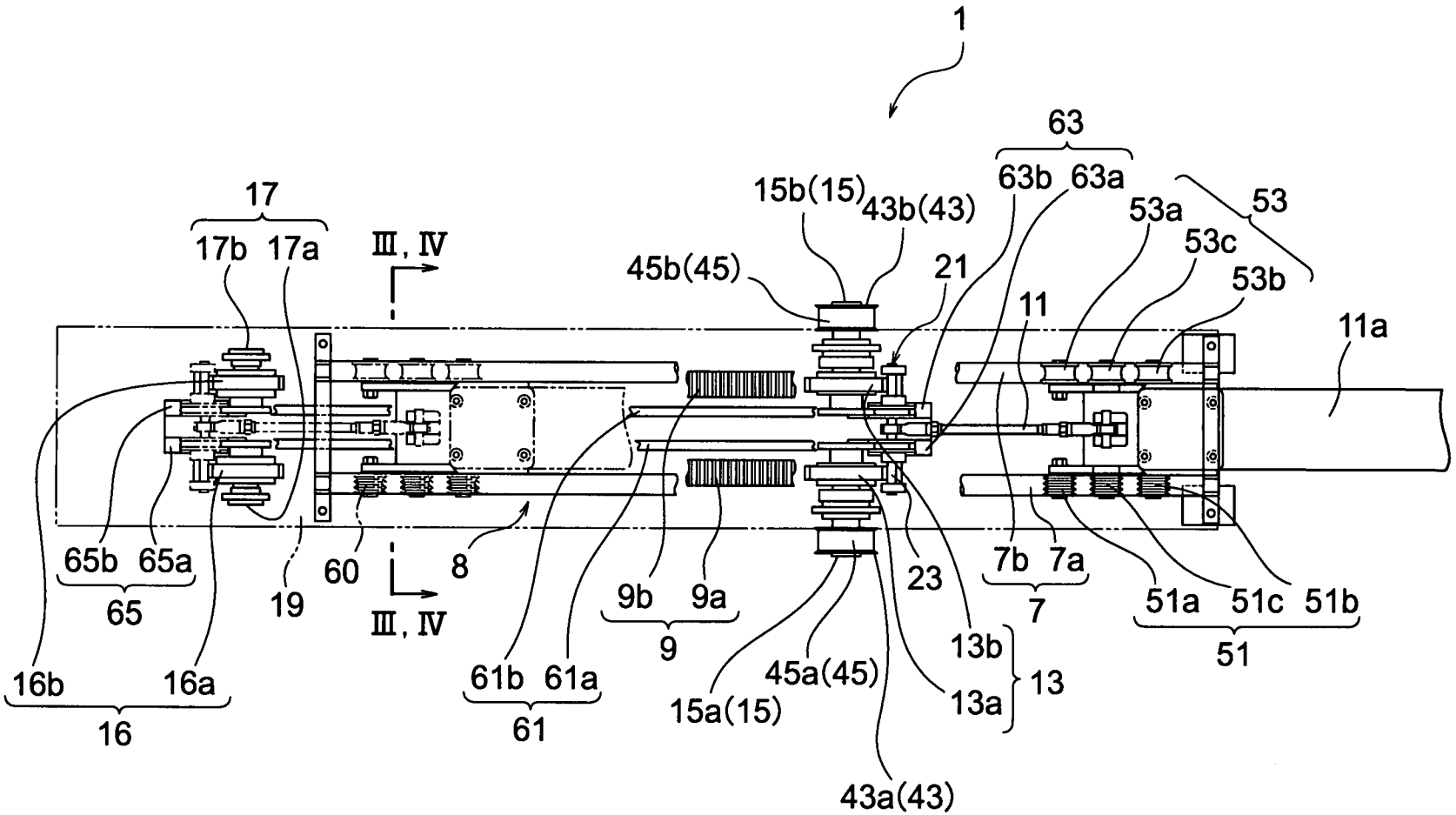
FIG. 2 is a partial plane view schematically showing main components of the loaf bread packaging apparatus according to the embodiment.
Figure 3:
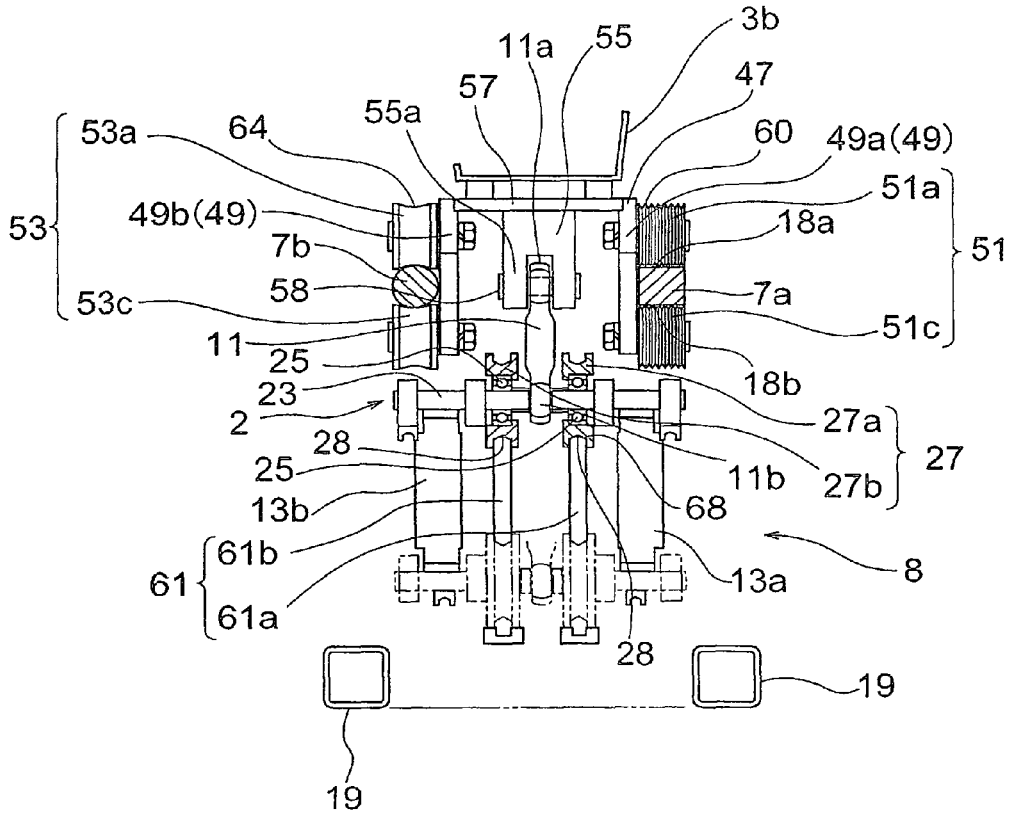
FIG. 3 is a cross section view taken on a line III-III of FIG. 2
Figure 4:
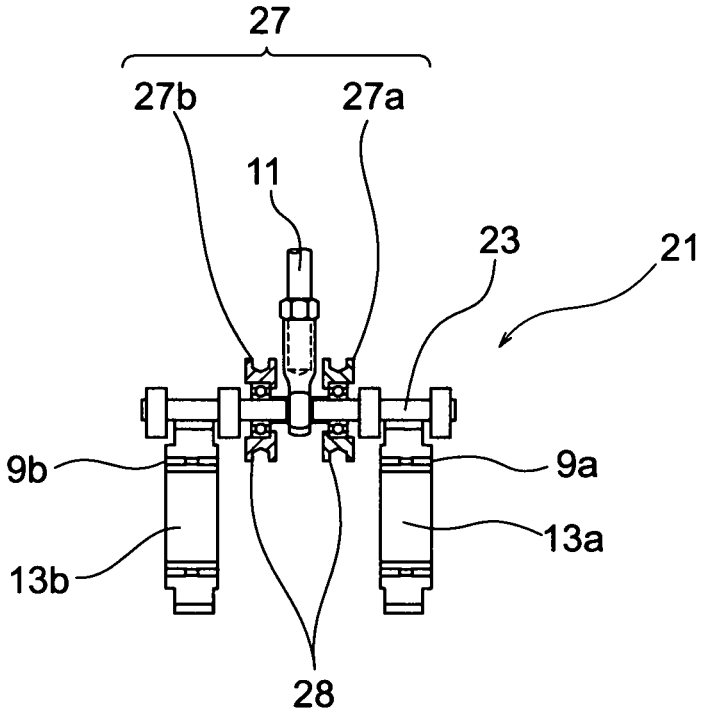
FIG. 4 is a cross section view taken on a line IV-IV of FIG. 2.

FIG. 1 is a front view schematically showing main components of a loaf bread packaging apparatus 1 according to the embodiment, FIG. 2 is a partial plane view schematically showing main components of the loaf bread packaging apparatus 1 according to the embodiment, FIG. 3 is a cross section view taken on a line of FIG. 2, and FIG. 4 is a cross section view taken on a line IV-IV of FIG. 2. It is noted that, while a plurality of shuttles 5 and link members 11 shown by the dash-dotted line in FIG. 1 are shown in order to illustrate the movement of the shuttle 5 and the link member 11, the loaf bread packaging apparatus 1 comprises a single shuttle 5. Throughout the specification, "downstream" refers to the direction in which the loaf bread is conveyed, and "upstream" refers to the opposite direction. Further, "right side" (or "the left side") refers to the right (the left) with respect to the direction in which the lower scoop 3*b* is moving away from the apparatus main body 19.

The loaf bread packaging apparatus 1 mainly comprises a movable member, i.e., the shuttle 5, on which a scoop 3 that can hold a bag for packaging the loaf bread is mounted; a guide member 7 on which the shuttle 5 is movably placed; a reciprocating motion mechanism 8 having an endless revolving member, i.e., a toothed belt 9 laid along the guide member 7; and a link member 11 linking the toothed belt 9 and the shuttle 5. The toothed belt 9 is revolved to one direction only (the direction of the arrow X), so that the shuttle 5 reciprocates on the guide member 7 (in the direction of the arrow R). As a material for the toothed belt 9, the followings can be used: synthetic rubber or polyurethane, or synthetic rubber or polyurethane containing glass fiber, aramid fiber, or steel wire.

The reciprocating motion mechanism 8 that reciprocates the shuttle 5 along the guide member 7 includes a pair of a driving pulley 13 and a driven pulley whose rotation axes are arranged in parallel spaced apart from each other by a predetermined distance; the toothed belt 9 wound around the driving pulley 13 and the driven pulley 16; and a movable member 21 that is moved according to the revolving of the toothed belt 9. As shown in FIG. 2, a driving shaft 15 of the driving pulley 16 and a driven shaft 17 of the driven pulley 16 are rotatably supported by the apparatus main body 19 such that their rotation axes are in parallel and spaced apart from each other by a predetermined distance.

Further, the driving shaft 15 includes a right driving shaft member 15*a* and a left driving shaft member 15*b*, which are rotatably supported such that the right driving shaft member 15*a* and the left driving shaft member 15*b* are spaced apart from each other and their axes are aligned on a line. Similarly, the driven shaft 17 includes a right driven shaft member 17*a* and a left driven shaft member 17*b*, which are rotatably supported such that the right driven shaft member 17*a* and the left driven shaft member 17*b* are spaced apart from each other and their axes are aligned on a line.

The right driving shaft member 15*a* and the left driving shaft member 15*b* are respectively fitted with a right driving pulley member 13*a* and a left driving pulley member 13*b* of the driving pulley 13. Similarly, the right driven shaft member 17*a* and the left driven shaft member 17*b* are respectively fitted with a right driven pulley member 16*a* and a left driven pulley member 16*b* of the driven pulley 16. Further, the toothed belt 9 includes a right toothed belt member 9*a* and a left toothed belt member 9*b* disposed in the lower side in the drawing sheet of FIG. 2, and the right toothed belt member 9*a* is wound around the right driving pulley member 13*a* and the right driven pulley member 16*a*. Similarly, the left toothed belt member 9*b* is wound around the left driving pulley member 13*b* and the left driven pulley member 16*b*.

The movable member 21 includes a single cylindrical link shaft member 23 extending between the right toothed belt 9*a* and the left toothed belt 9*b*; and a guide pulley 27 rotatably mounted on the link shaft member 23 via a rolling bearing 25. In the plane view (see FIG. 2), the link shaft member 23 extends in the perpendicular direction with respect to the direction in which the toothed belt members 9*a*, 9*b* extend. It is noted that the link shaft member 23 is fixed to the toothed belt members 9*a*, 9*b* by known fastening members. For example, the fastening member may include a pair of plate-like members that interpose the right and left toothed belt members 9*a*, 9*b* in the thickness direction of the toothed belt members 9*a*, 9*b*; and a bolt and nut fixing the plate-like members together.

As such, in the present embodiment, the movable member 21 fixed to the right and left toothed belt members 9*a*, 9*b* moves around the driving pulleys 13*a*, 13*b* and the driven pulleys 16*a*, 16*b* in accordance with the revolving of the right and left toothed belt members 9*a*, 9*b* arranged in parallel spaced apart from each other.

A drive motor 29 is provided as the drive source of the loaf bread packaging apparatus 1. The rotation force to the reciprocating motion mechanism 8 is supplied from the drive motor 29. A rotation shaft 31 of the drive motor 29 is provided with a toothed driving pulley 33 that is mounted coaxially with the rotation shaft 31. In addition, the servo motor may be used as the drive motor.

A toothed driving belt 37 is wound around the toothed driving pulley 33 and a toothed driven pulley 35, and the rotation force by the driving pulley 33 is transmitted to the toothed driven pulley 35 via the toothed driving belt 37. A transmission pulley 41 is fixed to a driven pulley rotation shaft 39 of the driven pulley 35 coaxially with the toothed driven pulley 35, so that the toothed driven pulley 35 and the transmission pulley 41 are arranged to be integrally rotatable. In addition, the driven pulley rotation shaft 39 is rotatably supported to the apparatus main body 19.

Further, a toothed rotation shaft pulley 43 is fixed to the driving shaft 15 of the reciprocating motion mechanism 8. The toothed rotation shaft pulley 43 includes a right driving pulley 43*a* and a left driving pulley 43*b* respectively fixed to the ends of the driving shaft 15. A right transmission belt 45*a* is wound around the transmission pulley 41 (see FIG. 1) and the right driving pulley 43*a*. Therefore, the rotation force by the drive motor 29 is transmitted to the right driving pulley 43*a* via the right toothed driven pulley 35. In addition, the rotation force of the drive motor 29 is transmitted to the left driving pulley 43*a* via a left transmission belt 45*b* from another toothed driven pulley (not shown) mounted on the driven pulley rotation shaft 39 and the transmission pulley 41 arranged coaxially with the toothed driven pulley. Therefore, the left driving pulley 43*b* and the right driving pulley 43*a* are configured to synchronously rotate.

Next, the movable member or the shuttle 5 will be explained. The shuttle 5 includes a shuttle base 47 having an inverse U-shape in the front view as shown in FIG. 3; wheels 51, 53 for allowing the shuttle base 47 to move; and a link protrusion 55 for linking to the reciprocating motion mechanism 8. The shuttle base 47 includes a right wall 49*a* and a left wall 49*b* that form a side wall 49; and a top wall 57 that connects the right side wall 49*a* and the left side wall 49*b*. The side wall 49 has a substantial T-shape in the side view as shown in FIG. 1. The wheel 51 mounted on the right side wall 49*a* (the left side wall 49*b*) includes two upper wheels 51*a*, 51*b* (53*a*, 53*b*) and a right lower wheel 51*c* (53*c*), and is rotatably supported.

The right upper wheels 51*a*, 51*b* are arranged spaced apart with respect to the moving direction R of the shuttle 5, and the right lower wheel 51*c* is arranged to locate between the right upper wheels 51*a*, 51*b* in the plane view (see FIG. 2). Further, in the side view (see FIG. 1), the right upper wheels 51*a*, 51*b*, and the right lower wheel 51*c* are arranged so as to interpose a right guide shaft member (second guide shaft member) 7*a* having a rectangular cross section.

Grooves 60 are provided to the outer circumference surfaces of the right upper wheels 51*a*, 51*b* and right lower wheel 51*c* that contact with the right guide shaft member 7*a*, and the grooves 60 extends around the circumference thereof by a predetermined pitch in the width direction of the wheel. On the other hand, an upper surface 18*a* and a lower surface 18*b* of the right guide shaft member 7*a* are flat. Therefore, the concavo-convex surfaces of the right upper and right lower wheels 51*a*, 51*b*, 51*c* roll on the upper surface 18*a* and the lower surface 18*b* of the right guide shaft member 7*a*.

Similarly, the left upper wheels 53*a*, 53*b* are arranged spaced apart with respect to the moving direction (the arrow R) of the shuttle 5, and the left lower wheel 53*c* is arranged to locate between the left upper wheels 53*a*, 53*b* in the plane view (see FIG. 2). Further, in the side view (see FIG. 1), the left upper wheels 53*a*, 53*b* and the left lower wheel 53*c* are arranged so as to interpose a left guide shaft member (first guide shaft member) 7*b*. It is noted that the left guide shaft member 7*b* has a circle vertical cross section with respect to its longitudinal direction. Further, the radius of the cross section of the left guide shaft member 7*b* is determined to be less than or equal to the radius of curvature of the outer circumference surface (rolling surface) at which the left upper wheels 53*a*, 53*b* and the left lower wheel 53*c* contact with the left guide shaft member 7*b*.

It should be noted that the present invention is not limited to the arrangement where the shape of the cross section of the left guide shaft member 7*b* is a circle and the outer circumference surfaces of the left upper wheels 53*a*, 53*b* and the left lower wheel 53*c* are the concave curved surface. Any arrangement will be possible as long as the radius of curvature of the convex (or concave) region of the left guide shaft member 7*b* at which the left upper wheel 53*a*, 53*b* and the left lower wheel 53*c* contact is determined to be less than or equal to (greater than or equal to) the radius of curvature of the concave (or convex) rolling surfaces of the left upper wheels 53*a*, 53*b* and the left lower wheel 53*c*, and the left upper wheels 53*a*, 53*b* and the left lower wheel 53*c* can roll on the left guide shaft member 7*b*.

As such, the shuttle 5 is configured to move along the right guide shaft member 7*a* and the left guide shaft member 7*b* by the wheels 51 and 53, respectively. It is noted that, as mentioned above, since the right upper and the right lower wheels 51*a*, 51*b*, 51*c* roll on the flat upper surface 18*a* and lower surface 18*b*, small errors in the distance between the right and the left guide shaft members 7*a* and 7*b* can be tolerated.

On the other hand, the outer circumference surfaces of the left upper and lower wheels 53*a*, 53*b*, 53*c* have a curvature surface 64, so that the left upper and lower wheels 53*a*, 53*b*, 53*c* can roll along the left guide shaft member 7*b* and the generation of vibration can be suppressed. That is, the left upper and left lower wheels 53*a*, 53*b*, 53*c* and the left guide shaft member 7*b* can function to restrict the moving direction of the shuttle 5, and the shuttle 5 is ensured to move along the right and left guide shaft member 7*b*. While it has been described that the right upper and right lower wheels 51*a*, 51*b*, 51*c* include the grooves 60, the present invention is not limited to this arrangement, and the surface contacting to the upper surface 18*a* and the lower surface 18*b* of the right guide shaft member 7*a* may be flat.

Furthermore, instead of the left guide shaft member 7*b* and the left upper wheels 53*a*, 53*b* and the left lower wheel 53*c*, the right guide shaft member 7*a* and the right upper wheels 51*a*, 51*b* and the right lower wheel 51*c* may include the shape with a predetermined radius of curvature, and the flat shapes of the right guide shaft member 7*a* and the right upper wheels 51*a*, 51*b* and the right lower wheel 51*c* may be applied to the left guide shaft member 7*b* and the left upper wheels 53*a*, 53*b* and the left lower wheel 53*c*.

Further, the right guide shaft member 7*a* and the right upper wheels 51*a*, 51*b* and the right lower wheel 51*c* as well as the left guide shaft member 7*b* and the left upper wheels 53*a*, 53*b* and the left lower wheel 53*c* may include the shape with a predetermined radius of curvature. Furthermore, the number of the upper wheels and the lower wheels can be changed according to the size or the shape of the shuttle 5 as long as at least one pair of upper wheel and lower wheel can interpose the guide shaft member.

The link protrusion 55 extends from the top wall 57 of the shuttle 5 in parallel with the side wall 49. The end of the link protrusion 55 is pivotably coupled by pin to one end portion 11*a* of the link member 11 via a pin 58. Further, the other end portion 11*b* of the link member 11 is pivotably mounted on the link shaft member 23 at its substantial center in the axial direction. Further, the length of the longitudinal direction of the link member 11 is determined such that the toothed belt 9 can rotate in the direction of the arrow X to reciprocate the link member 11 between the predetermined positions of the guide member (for example, the left end portion and the right end portion of the guide member 7 in FIG. 1).

Further, the reciprocating motion mechanism 8 of the loaf bread packaging apparatus 1 of the present embodiment includes a roller guide 59. The roller guide 59 includes an inner roller guide 61 which is disposed along a linear moving region of the toothed belt 9 and which is inside the region surrounded by the toothed belt 9; and an outer roller guides 63, 65 which is disposed along a curved moving region of the toothed belt 9 and which is outside the region surrounded by the toothed belt 9.

The inner roller guide 61 includes an inner right roller guide member 61*a* and an inner left roller guide member 61*b*, each of which includes a plate-like member having a rectangular shape and a predetermined thickness. As shown in FIG. 3, the inner right and inner left roller guide members 61*a*, 61*b* are fixed to the apparatus main body 19 in parallel to each other. Since the inner right and inner left roller guide members 61*a*, 61*b* are of the same shape and the same size, the inner upper roller guide member 61*a* only will be explained.

An circumference portion 68 of the inner right roller guide member 61*a* engages with a pulley groove 28 provided on the outer circumference surface of the guide pulley 27 fixed to the link shaft member 23, and moves on the inner right roller guide member 61*a* in accordance with the movement of the link shaft member 23.

Here, the balance of the force working on a link shaft member A (see FIG. 1) will be explained. In FIG. 1, the shuttle 5 connected to the link shaft member A is moving toward the right with respect to the direction of the arrow R, that is, the scoop 3 is moving forward. In this case, force TA along the longitudinal direction of the link shaft 11 is applied to the link shaft member A. That is, force VA that is the vertical downward component of the force TA is applied to the link shaft member A, and the force to deflect the right toothed belt member 9*a* downward in FIG. 1 is applied thereto. In order to prevent the right belt member 9*a* from being deflected by the vertical downward component force VA, the embodiment is configured such that the inner right roller guide member 61*a* as described above supports the vertical downward component force VA.

Further, the balance of the force working on the link shaft member B will be explained. In FIG. 1, the shuttle 5 connected to the link shaft member B is moving toward the left with respect to the direction of the arrow R, that is, the scoop 3 is moving backward. In this case, force TB along the longitudinal direction of the link shaft 11 is applied to the link shaft member B. That is, force VB that is the vertical upward component of the force TB is applied to the link shaft member B, and the force to deflect the right toothed belt member 9*a* upward in FIG. 1 is applied thereto. In order to prevent the right belt member 9*a* from being deflected by the vertical upward component force VB, the embodiment is configured such that the inner right roller guide member 61*a* as described above supports the vertical upward component force VB.

Note that it is clear that the inner left roller guide member 61*b* functions similarly to the inner right roller guide member 61*a*. Therefore, there is no deflection generated on the toothed belt 9 in the linear moving region between the driving pulley 13 and the driven pulley 16. As a result, the shuttle can move at a predetermined speed.

The outer roller guide of the present embodiment includes a front outer roller guide member 63 and a rear outer roller guide member 65. Further, the front outer roller guide 63 includes a front outer right roller guide member 63*a* and a front outer left roller guide member 63*b* corresponding to a right guide pulley 27*a* and a left guide pulley 27*b*. Similarly, the rear outer roller guide 65 includes a rear outer right roller guide member 65*a* and a rear outer left roller guide member 65*b* corresponding to the right guide pulley 27*a* and the left guide pulley 27*b*.

The front outer right and left roller guide members 63*a*, 63*b* and rear outer right and left roller guide members 65*a*, 65*b* all are the plate-like members provided with a semicircle guide concave portion 67, and are fixed to the apparatus main body 19. The radius of curvature of the guide concave portion 67 is determined to be the same as the radius of curvature of the track by the portion farthest from the axis of the driving pulley 13 when the guide pulley 27 mounted on the link shaft member 23 passes by the driving pulley 13 and the driven pulley 16 (i.e., the curved moving region). Therefore, the driving pulley 13 and the driven pulley 16 are arranged to be rotatably supported by the outer roller guide 65.

The front outer right and left roller guide members 63*a*, 63*b* and the rear outer right and left roller guide members 65*a*, 65*b* each includes a plate-like member having a rectangular shape and a predetermined thickness. As shown in FIG. 1, the front outer right and left roller guide members 63, 63*b* are fixed to the apparatus main body 19 in parallel to each other. Since the front outer right and left roller guide members 63*a*, 63*b* and the rear outer right and left roller guide members 65*a*, 65*b* are of the same shape and the same size, the front outer right roller guide member 63*a* and the rear outer right roller guide member 65*a* only will be explained.

The right guide pulley 27*a* fixed to the link shaft member 23 rolls on the guide concave portion 67 of the front outer right roller guide member 63*a* (and a rear outer right roller guide member 65*a*) in the curved moving region of the right toothed belt 9*a*.

Here, the balance of the force working on the link shaft member 23 is considered. The shuttle 5 connected to the link shaft member 23 is moving in the direction of the arrow X in FIG. 1.

When the shuttle 5 moves to the left (or right) with respect to the direction of the arrow R along the linear moving region and the guide pulley 27 goes around the outer circumference of the driven pulley 16 (or the driving pulley 13), centrifugal force CA in, the radial direction from the axis of the driven shaft 17 (or the driving shaft 15) works on the link shaft member C. The outer roller guides 63, 65 are arranged to support the centrifugal force CA. Therefore, when the guide pulley 27 is in the curved moving region, the excessive load on the toothed belt 9 can be prevented. As a result, the durability of the loaf bread packaging apparatus 1 can be improved.

The operation of the loaf bread packaging apparatus 1 having the above configuration will be explained. As shown in FIG. 1, the rotation force in the direction of the arrow 69 of the rotation shaft 31 generated by driving the drive motor 29 is transmitted to the toothed driving pulley 43 via the transmission pulley 41. When the toothed driving pulley 43 rotates in the direction of the arrow X, the toothed belt 9 goes around the driving pulley 13 and the driven pulley 16. According to the revolving of the toothed belt 9, the link shaft member 23 connected to the toothed belt 9 goes around the driving pulley 13 and the driven pulley 16.

When the link shaft member 23 moves within the region of the belt 9 extending over the inter-axis plane defined by the rotation axes of the driving pulley 13 and the driven pulley 16 in FIG. 1, the shuttle 5 is moved forward to the right in FIG. 1. Contrarily, the link shaft member 23 locates within the region of the belt 9 extending under that inter-axis plane in FIG. 1, the shuttle 5 is moved to the left (in the backward direction) in FIG. 1. As such, by revolving the link shaft member 23 in a single direction (direction X) only, a lower scoop 3*b* and an upper scoop 3*a* mounted on the shuttle 5 reciprocate in the direction across a conveying path P of the loaf bread. In addition, the drive motor 29 is controlled such that the shuttle 5 moves at a constant speed (uniform speed) or an acceleration and deceleration.

[Loaf Bread Packaging System]

Figure 5A:
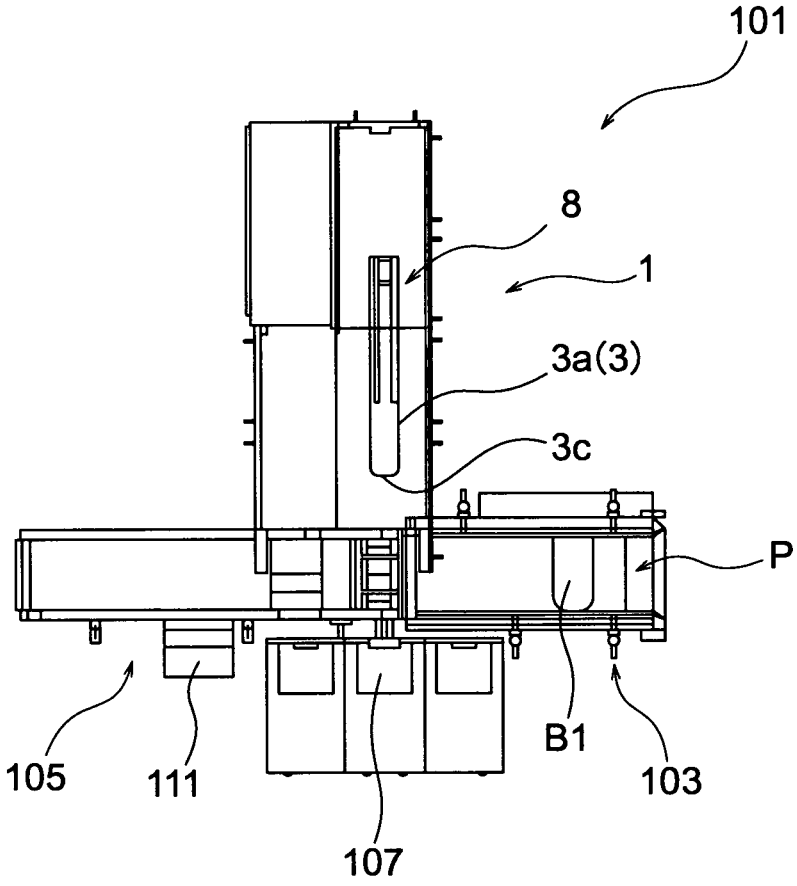
FIG. 5A is a plane view schematically showing the entire loaf bread packaging system having the loaf bread packaging apparatus according to the embodiment.

In a factory for producing the loaf bread, in general, used is a packaging system for continuously performing the process of producing the loaf bread and the process of packaging the loaf bread. Therefore, the brief explanation will be provided with respect to a loaf bread packaging system 101 in which an introduction conveyer for carrying in the loaf bread, a feed-out conveyer for carrying out the loaf bread, and the loaf bread apparatus 1 according to the embodiment are connected. FIG. 5A is a plane view of the loaf bread packaging system 101, and FIG. 5B is a front view of the loaf bread packaging system 101.

Figure 5B:
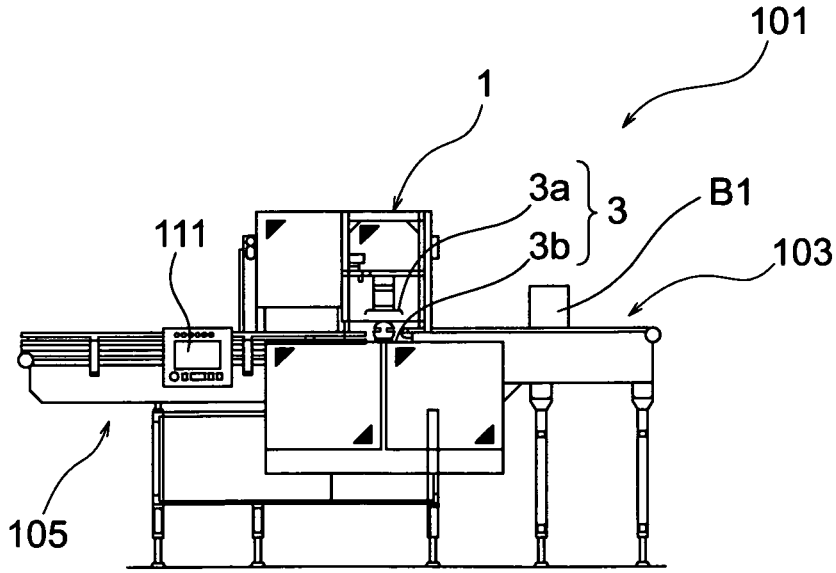
FIG. 5B is a front view schematically showing the entire loaf bread packaging system having the loaf bread packaging apparatus according to the embodiment.

The loaf bread packaging apparatus 1 extends in the direction across the conveying path P that extends in the left-right direction of FIG. 5B. In FIG. 5A, the upper scoop 3*a*(3) is arranged such that it is moved forward and backward in the vertical direction with respect to the conveying path P by the reciprocating motion mechanism 21. Once exceeding the conveying path P, the end portion 3*c* of the scoop 3 holds and opens the packaging bag 107. The packaging bag 107 is held with being opened (the end portion 3*c* of the scoop 3 reaches the maximum forward position), and the loaf bread B1 is introduced between the upper scoop 3*a* and the lower scoop 3*b*.

In a state where the scoop 3 holds the loaf bread B1, when the scoop 3 moves back to the reciprocating motion mechanism 8, the opened packaging bag 107 is moved back to the position where the loaf bread B1 is held. When the scoop 3 is moved back, the loaf bread B1 is maintained on the conveying path P by the holding means (not shown). That is, the loaf bread B1 does not follow the backward motion of the lower scoop 3*b*. As a result, the loaf bread B1 is accommodated within the packaging bag 107 and the loaf bread falls from the lower scoop 3*b*.

An in-feed conveyer 103 extends along the conveying path P, and is the conveying means for introducing the loaf bread B1 to the scoop 3. Therefore, the in-feed conveyer 103 is disposed upstream the reciprocating motion mechanism 21 in the conveying path P.

Further, a discharge conveyer 105 extends along the conveying path P, and is used to convey to the next process the loaf bread B1 which has been accommodated in the packaging bag 107 by the scoop 3. Therefore, the discharge conveyer 105 is disposed downstream the reciprocating motion mechanism 21 in the conveying path P.

The in-feed conveyer 103 and the discharge conveyer 105 are conventionally known. For example, conveying means is used in which an endless revolving member is wound around two sprockets and a flight for impelling the loaf bread B1 is mounted on the endless revolving member. The endless revolving member is driven at a predetermined timing, so that the loaf bread B1 is introduced into the scoop 3. The loaf bread B1 packaged by the loaf bread apparatus 1 falls onto the discharge conveyer 105 and is conveyed to the next process by the discharge conveyer 105. In addition, the in-feed conveyer 103, the discharge conveyer 105, and the loaf bread packaging apparatus 1 can be controlled to make synchronization in a predetermined timing.

In the present embodiment, the link member 11 to which the shuttle 5 is connected is mounted at the middle in the longitudinal direction of the link shaft member 23, and two guide pulleys 27 are provided to both sides of the link shaft member 23 symmetrically with respect to the link member 11. This arrangement allows the link shaft member 23 to move stably in accordance with the revolving of the toothed belt 9. However, the present invention is not limited to this arrangement. For example, if the load on the link shaft member is relatively small, it is possible that one of the guide pulleys 27 only is provided to form the link shaft member 23 in a cantilever beam structure. Further, it is possible to configure the bread packaging apparatus and the bread packaging system having any one of the inner roller guide 61, the outer roller guides 63 and 65, or having none of the inner roller guide 61, the outer roller guides 63 or 65.

Further, while the pulleys as rotational members and the belt as an endless revolving member are used to transmit the rotation force in the present embodiment, it is possible to transmit the rotation force by sprockets as rotational members and a chain as an endless revolving member.

It is noted that, although the loaf bread packaging apparatus of the present embodiment is configured to package the loaf bread with the polyethylene bag, the present invention is not limited to this configuration. The packaging material for packaging the bread is not limited to the plastic material such as polypropylene, polyester, nylon, and the like, however, the material made of, e.g., paper, metal, cloth, and the like may be used.

While the present embodiment has been described by using the loaf bread of the rectangular solid shape, the present invention is not limited for the loaf bread, and thus can be applied to the bread packaging apparatus and the bread packaging system for conveying the breads of various sizes and shapes.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-211468, filed Sep. 21, 2010, which is hereby incorporated by reference herein in its entirety.

What is claimed is:

1. A bread packaging system, comprising:

a scoop for holding a packaging member to package bread;

a movable member on which the scoop is mounted;

a guide member for defining a moving path along which the movable member is moved;

a reciprocating motion mechanism reciprocating the movable member along the guide member, the reciprocating motion mechanism comprising a pair of rotation members and an endless revolving member wound around and capable of revolving around the pair of rotation members; and a link member comprising one end portion connected to the endless revolving member to revolve, together with the endless revolving member, around the pair of rotation members, and another end portion connected to the movable member, wherein the bread packaging system is configured to reciprocate the movable member along the guide member by revolving the endless revolving member in one direction, and wherein the movable member comprises a plurality of revolvable rolling members between which the guide member is sandwiched and which rotate on the guide member.

2. A bread packaging system according to claim 1, wherein the movable member is moved in a uniform speed or acceleration and deceleration.

3. A bread packaging system according to claim 1, wherein the plurality of revolving rolling members comprise a revolvable first rolling member provided with a rolling surface having a predetermined radius of curvature, and the guide member comprises a first guide shaft member provided with a rolling path along which the first rolling member rolls, the rolling path having a radius of curvature less than or equal to the radius of curvature of the rolling surface of the first rolling member.

4. A bread packaging system according to claim 2, wherein the plurality of revolving rolling members comprise a revolvable first rolling member provided with a rolling surface having a predetermined radius of curvature, and the guide member comprises a first guide shaft member provided with a rolling path along which the first rolling member rolls, the rolling path having a radius of curvature less than or equal to the radius of curvature of the rolling surface of the first rolling member.

5. A bread packaging system according to claim 3, wherein the plurality of revolving rolling members comprise a revolvable second rolling member provided with a flat rolling surface, the guide member comprises a second guide shaft member provided with a flat rolling path on which the second rolling member rolls, and the first guide shaft member and the second guide shaft member are arranged in parallel spaced apart from each other.

6. A bread packaging system according to claim 4, wherein the plurality of revolving rolling members comprise a revolvable second rolling member provided with a flat rolling surface, the guide member comprises a second guide shaft member provided with a flat rolling path on which the second rolling member rolls, and the first guide shaft member and the second guide shaft member are arranged in parallel spaced apart from each other.

7. A bread packaging system according to claim 1, wherein a revolvable guide pulley is mounted on the one end portion of the link member, and a first roller guide member is disposed within a region surrounded by the endless revolving member so that the one end portion of the link member is arranged to support the guide pulley when the one end portion is within a linear moving region of the endless revolving member.

8. A bread packaging system according to claim 2, wherein a revolvable guide pulley is mounted on the one end portion of the link member, and a first roller guide member is disposed within a region surrounded by the endless revolving member so that the one end portion of the link member is arranged to support the guide pulley when the one end portion is within a linear moving region of the endless revolving member.

9. A bread packaging system according to claim 3, wherein a revolvable guide pulley is mounted on the one end portion of the link member, and a first roller guide member is disposed within a region surrounded by the endless revolving member so that the one end portion of the link member is arranged to support the guide pulley when the one end portion is within a linear moving region of the endless revolving member.

10. A bread packaging system according to claim 4, wherein a revolvable guide pulley is mounted on the one end portion of the link member, and a first roller guide member is disposed within a region surrounded by the endless revolving member so that the one end portion of the link member is arranged to support the guide pulley when the one end portion is within a linear moving region of the endless revolving member.

11. A bread packaging system according to claim 5, wherein a revolvable guide pulley is mounted on the one end portion of the link member, and a first roller guide member is disposed within a region surrounded by the endless revolving member so that the one end portion of the link member is arranged to support the guide pulley when the one end portion is within a linear moving region of the endless revolving member.

12. A bread packaging system according to claim 6, wherein a revolvable guide pulley is mounted on the one end portion of the link member, and a first roller guide member is disposed within a region surrounded by the endless revolving member so that the one end portion of the link member is arranged to support the guide pulley when the one end portion is within a linear moving region of the endless revolving member.

13. A bread packaging system according to claim 7, wherein a second roller guide member is disposed outside the region surrounded by the endless revolving member so that the one end portion of the link member is arranged to support the guide pulley when the one end portion is within a curved moving region of the endless revolving member.

14. A bread packaging system according to claim 8, wherein a second roller guide member is disposed outside the region surrounded by the endless revolving member so that the one end portion of the link member is arranged to support the guide pulley when the one end portion is within a curved moving region of the endless revolving member.

15. A bread packaging system according to claim 9, wherein a second roller guide member is disposed outside the region surrounded by the endless revolving member so that the one end portion of the link member is arranged to support the guide pulley when the one end portion is within a curved moving region of the endless revolving member.

16. A bread packaging system according to claim 10, wherein a second roller guide member is disposed outside the region surrounded by the endless revolving member so that the one end portion of the link member is arranged to support the guide pulley when the one end portion is within a curved moving region of the endless revolving member.

17. A bread packaging system according to claim 11, wherein a second roller guide member is disposed outside the region surrounded by the endless revolving member so that the one end portion of the link member is arranged to support the guide pulley when the one end portion is within a curved moving region of the endless revolving member.

18. A bread packaging system according to claim 12, wherein a second roller guide member is disposed outside the region surrounded by the endless revolving member so that the one end portion of the link member is arranged to support the guide pulley when the one end portion is within a curved moving region of the endless revolving member.

19. A bread packaging system according to claim 1, wherein a revolvable guide pulley is mounted to the one end portion of the link member, wherein a second roller guide member is disposed outside the region surrounded by the endless revolving member so that the one end portion of the link member is arranged to support the guide pulley when the one end portion is within a curved moving region of the endless revolving member.

20. A bread packaging system according to claim 2, wherein a revolvable guide pulley is mounted to the one end portion of the link member, wherein a second roller guide member is disposed outside the region surrounded by the endless revolving member so that the one end portion of the link member is arranged to support the guide pulley when the one end portion is within a curved moving region of the endless revolving member.

21. A bread packaging system according to claim 3, wherein a revolvable guide pulley is mounted to the one end portion of the link member, wherein a second roller guide member is disposed outside the region surrounded by the endless revolving member so that the one end portion of the link member is arranged to support the guide pulley when the one end portion is within a curved moving region of the endless revolving member.

22. A bread packaging system according to claim 4, wherein a revolvable guide pulley is mounted to the one end portion of the link member, wherein a second roller guide member is disposed outside the region surrounded by the endless revolving member so that the one end portion of the link member is arranged to support the guide pulley when the one end portion is within a curved moving region of the endless revolving member.

23. A bread packaging system according to claim 5, wherein a revolvable guide pulley is mounted to the one end portion of the link member, wherein a second roller guide member is disposed outside the region surrounded by the endless revolving member so that the one end portion of the link member is arranged to support the guide pulley when the one end portion is within a curved moving region of the endless revolving member.

24. A bread packaging system according to claim 6, wherein a revolvable guide pulley is mounted to the one end portion of the link member, wherein a second roller guide member is disposed outside the region surrounded by the endless revolving member so that the one end portion of the link member is arranged to support the guide pulley when the one end portion is within a curved moving region of the endless revolving member.

25. A bread packaging system according to claim 1, wherein the pair of rotation members includes a pulley or a sprocket and the endless revolving member includes a belt or a chain.

26. A bread packaging system according to claim 1, wherein the plurality of revolving rolling members comprise a plurality of revolvable first rolling members provided with a rolling surface having a predetermined radius of curvature, and the guide member comprises a plurality of first guide shaft members provided with a rolling path along which the plurality of first rolling members roll, the rolling path having a radius of curvature less than or equal to the radius of curvature of the rolling surface of the plurality of revolvable first rolling members.

27. A bread packaging system according to claim 1, wherein the plurality of revolvable rolling members are displaced in vertical symmetry with each other when viewed from a front view.

28. A bread packaging system according to claim 27, wherein the plurality of revolvable rolling members are opposed to each other with respect to the link member when viewed from the front view.

* * * * *